US007296376B2

(12) United States Patent
Kidd

(10) Patent No.: US 7,296,376 B2
(45) Date of Patent: Nov. 20, 2007

(54) INTERCHANGEABLE SIGHT SYSTEM AND METHOD FOR REMOVABLY MOUNTING AN OPTICAL ALIGNMENT APPARATUS

(75) Inventor: Anthony Wayne Kidd, Columbus, GA (US)

(73) Assignee: Keng's Firearms Specialty, Inc., Atlanta, GA (US)

( * ) Notice: Subject to any disclaimer, the term of this patent is extended or adjusted under 35 U.S.C. 154(b) by 43 days.

(21) Appl. No.: 11/207,766

(22) Filed: Aug. 22, 2005

(65) Prior Publication Data

US 2007/0234625 A1 Oct. 11, 2007

Related U.S. Application Data

(60) Provisional application No. 60/602,886, filed on Aug. 20, 2004.

(51) Int. Cl.
*F41G 1/033* (2006.01)
*F41G 1/16* (2006.01)
*F41G 1/00* (2006.01)

(52) U.S. Cl. ..... 42/136; 42/111; 89/41.17

(58) Field of Classification Search ..... 42/111, 42/135, 136; 89/41.17, 41.19
See application file for complete search history.

(56) References Cited

U.S. PATENT DOCUMENTS 1,618,225 A * 2/1927 Redfield ..... 42/140
2,039,907 A * 5/1936 Jefferson ..... 42/140
2,434,712 A * 1/1948 Mossberg ..... 42/136
2,645,017 A * 7/1953 Haase ..... 42/111
2,738,585 A * 3/1956 Vissing ..... 42/129
3,648,374 A * 3/1972 Lewis ..... 42/136
3,877,166 A * 4/1975 Ward ..... 42/127
4,085,511 A * 4/1978 Kovac ..... 42/126
4,878,308 A * 11/1989 Rose ..... 42/112
5,068,968 A * 12/1991 Sillery ..... 89/200
5,430,967 A * 7/1995 Woodman et al. ..... 42/114
5,467,552 A * 11/1995 Cupp et al. ..... 42/125
6,185,854 B1 * 2/2001 Solinsky et al. ..... 42/111
6,574,901 B1 * 6/2003 Solinsky et al. ..... 42/146
6,865,838 B2 * 3/2005 Williams et al. ..... 42/51
2006/0207157 A1 * 9/2006 Keng ..... 42/132

* cited by examiner

*Primary Examiner*—Bret Hayes
(74) *Attorney, Agent, or Firm*—Jones, Tullar & Cooper, P.C.

(57) ABSTRACT

A rugged, releasably attachable or interchangeable optical alignment system well suited for use as with pistol sights includes a sight body carrying a leaf spring locking member adapted to releasably engage a pistol's indentation. The sight body's leaf spring member is inserted into the pistol in a side opening transverse receiving notch with a pinned end of the leaf spring locking member sliding transversely over the pistol indentation's end wall open segment (at the side of the pistol). The user slides the sight base toward the bore's central axis to its fullest transverse extent, whereupon the leaf spring member's first end abuts the indentation's closed end wall. At this moment, the leaf spring locking member's free distal second end springs down and releasably engages and abuts the indentation's end wall, thus releasably locking the sight base to the pistol.

20 Claims, 6 Drawing Sheets

INTERCHANGEABLE SIGHT SYSTEM AND METHOD FOR REMOVABLY MOUNTING AN OPTICAL ALIGNMENT APPARATUS

CROSS-REFERENCE TO RELATED APPLICATIONS AND CLAIM TO PRIORITY

This application claims benefit (under 35 U.S.C. §§ 119(e) and 120) of and priority to U.S. provisional patent application No. 60/602,886, filed Aug. 20, 2004, the entire disclosure of which is incorporated herein by reference.

BACKGROUND OF THE INVENTION

1. Field of the Invention

The present invention relates to an interchangeable, adjustable support or mount for an optical alignment device such as a firearm sight and a method for removeably mounting optical devices such as gun sights on pistols or other firearms.

2. Discussion of the Prior Art

At present, a wide variety of optical sights are available for use on firearms such as pistols.

A typical handgun or pistol has optical alignment fixtures or sights including a front sight and a rear sight which are aligned with one another to form a sight picture for aligning the pistol's point of aim on the target. Prior art pistol sights are usually mounted along the top edge of the pistol. Traditional semi-automatic pistols (such as the well known Colt™ model 1911, caliber 45) include a grip or handle carrying a lower receiver and a trigger mechanism and a slide member is slidably supported on the lower receiver.

The traditional front sight is a vertically projecting blade or ramp-like member mounted at the front of the slide and the rear sight is adapted for mounting to the rear of the slide using a dovetailed transverse protrusion that mates with a corresponding transverse dovetailed slot in the slide.

Police officers and members of the military require especially rugged sights on their weapons and so a genre of firearms and accessories adapted for "combat carry" has evolved to serve their special needs.

Fixed sights are intended to provide a smooth and snag-free draw, a clear sight picture and rugged service; the fixed sight shown in Design Pat. D447,205 is one example. Others, including Wayne Novak, have also developed a number of designs for sights intended to provide rugged service, and such sights are often fitted in a transverse dovetailed notch having standardized dimensions known in the industry as the "Novak Notch" dimensions. By "transverse" is meant in a direction at a right angle to the pistol bore's central axis and lying in a horizontal plane when the pistol is held in a standard grip with the bore central axis in a horizontal plane. Generally, the standardized dimensions for the notch will accept a dovetail-like projection that is 12.5 millimeters (mm) in fore-aft length on a planar bottom surface and tapers inwardly at 70 degrees from horizontal on front and back wall surfaces; the bottom planar surface of the projection is preferably 3 mm in vertical height from the upper surface of the notch opening, within customary gunsmithing tolerances.

While the combat sights of the prior art do provide a smooth and snag-free draw, a clear sight picture and rugged service, they often do not provide a wide enough range of adjustability and are not readily changed with other sights, since sights are often installed by gunsmiths using specialized tools.

Those removable sight mounts of the prior art have proven unsuitable because they do not maintain the point of aim of "zero" when removed and re-installed.

Pistol sights are often used in a variety of situations. A sight is customarily optically aligned along the axis of the bore and used to align the bore of the firearm with the target. Target sights are usually adjustable in the left and right direction for "windage" and in the up and down direction for "elevation." Usually, a shooter will mount a sight to a firearm and then immediately "zero" the sight by a procedure of adjusting windage and elevation settings so that the sight's point of aim corresponds with the point of impact for a selected target at a desired range.

If a sight is mounted to a large caliber firearm generating large recoil forces, the zero may change after firing several rounds and the sight must then be adjusted for proper zero again. Traditional combat carry sights, as described above, are usually not adjustable for windage, and so shooters have turned to permanently altering the front sight pose by filing it down (to raise the point of impact) or substituting taller front sight blades (to lower the point of impact). Adjustments for windage have required the shooter to strike the side of the sight with a pin punch and hammer, to force the sight laterally in the notch, a procedure which does not permit fine adjustment.

There has been a long felt need, then, for a method and apparatus permitting attachment and adjustment of a combat carry style rear sight or the like on a firearm such as a pistol, permitting the shooter to quickly and easily zero the sights and permitting the user to change to different sights in an interchangeable manner.

OBJECTS AND SUMMARY OF THE INVENTION

Accordingly, it is a primary object of the present invention to overcome the above mentioned difficulties by providing a method and interchangeable apparatus permitting the user to rigidly but removably affix a sight onto a firearm in a manner likely to permit precise and convenient sight adjustment, and permitting convenient changes from one type or size sight to another.

Another object of the present invention is removably attaching an adjustable optical alignment device to a mount suited for rugged service.

The aforesaid objects are achieved individually and in combination, and it is not intended that the present invention be construed as requiring two or more of the objects to be combined unless expressly required by the claims attached hereto.

The interchangeable sight system of the present invention preferably includes a pistol slide or firearm receiver having a transverse receiving notch. As above, "transverse" means in a left-right direction, at a right angle to the firearm's bore and lying in a substantially horizontal plane when the firearm is positioned with the bore's central axis in a horizontal plane. Generally, the industry standards define a notch that will accept what is known as a Novak-style dovetail projection and the notch is, in the exemplary embodiment, 12.5 millimeters (mm) in fore-aft length along a substantially planar bottom surface or floor terminating fore and aft in front and back wall surfaces that taper toward one another or inwardly at 70 degrees from the notch's planar bottom surface. The notch's bottom planar surface is preferably 3 mm in vertical height from the notch's upward facing opening, within customary gunsmithing tolerances.

The transverse notch's bottom surface preferably includes a substantially ovoid transversely elongated detent or indentation having a first substantially vertical closed movement limiting end wall opposite a second substantially vertical end wall. The indentation's second end wall defines an open segment that provides access to the interior of the indentation from the side of the pistol slide or firearm receiver.

The interchangeable sight base is dimensioned to slidably engage the transverse receiving notch and carries, in the exemplary embodiment, a dovetail projection that is 12.5 millimeters (mm) in fore-aft length along a planar bottom surface and the dovetail tapers inwardly at approximately 70 degrees from horizontal to provide angled front and back wall surfaces; the bottom planar surface of the dovetail projection is preferably 3 mm in vertical height from the surface of the sight base, within customary gunsmithing tolerances.

The dovetail projection's bottom surface preferably carries a substantially ovoid transversely elongated tempered steel leaf spring biased locking member having a first substantially vertical proximal end surface (dimensioned to engage and abut the indentation's first, movement limiting, closed end wall) opposite a second substantially vertical distal end surface (dimensioned to releasably engage and abut the indentation's second end wall). The leaf spring biased locking member is preferably pinned or fastened to the dovetail's bottom surface.

Preferably, dovetail projection's bottom surface includes a substantially ovoid transversely elongated indentation having a first substantially vertical closed end wall opposite a second substantially vertical end wall. The dovetail's indentation second end wall defines an open segment that provides access to the interior of the indentation from the side of the dovetail projection and the dovetail's indentation has a sidewall vertical extent (or depth) that substantially equals the thickness of the leaf spring biased locking member so that the leaf spring locking member can be forced against the dovetail bottom surface and completely into the dovetail indentation, so as to completely disengage the leaf spring biased locking member from the firearm receiver's transverse notch.

In use, the sight base dovetail projection carrying the leaf spring member is inserted into the side opening of the firearm's transverse receiving notch with the pinned end of the leaf spring locking member sliding transversely over the receiver indentation's second end wall open segment (at the side of the pistol slide or firearm receiver). The user slides the sight base into the receiving notch to its fullest transverse extent, whereupon the leaf spring locking member's vertical pinned end surface rigidly engages and abuts the indentation's first closed end wall. At this moment, the leaf spring locking member's free distal end is biased to spring down and the locking member's vertical distal end surface releasably engages and abuts the indentation's second end wall, thus releasably locking the sight base to the firearm receiver (or pistol slide).

The free, distal end of the leaf spring locking member preferably carries a manipulable, transversely projecting tab or extension that projects laterally out through the firearm indentation's side wall opening, so that a user can force an implement such as a ramp-shaped tool end, screwdriver blade tip or spitzer-shaped bullet tip to force or urge the free, distal end of the leaf spring locking member up and away from the indentation's second end wall, thus releasing the sight base from fixed engagement with the firearm. Once the leaf spring locking member has been disengaged or unlocked, the user may slide the sight base transversely in the receiver's notch toward and over the receiver indentation's second end wall open segment (at the side of the pistol slide or firearm receiver).

Preferably, the firearm's exterior surface includes a spherical indentation proximate the second end wall's opening to provide the camming surface proximate the indentation's second end wall open segment. The spherical indentation near the indentation's open wall segment permits the leaf spring locking member's transversely projecting tab to project from the side of the firearm and permits a user to use an implement such as pointed bullet end, knife or awl when forcing the free, distal end of the leaf spring locking member up to unlock the sight base.

The leaf spring locking member is preferably retained in the dovetail projection by sliding the spring member into grooves in the dovetail indentation's first sidewall. A through-hole in the spring member receives a flanged leaf spring member retaining pin that is held captive by a perpendicular keeper pin peened in place after the leaf spring locking member distal end and flanged retaining pin are positioned in the dovetail indentation proximate the dovetail indentation's first sidewall.

The interchangeable sight system of the present invention may optionally include a kit having several front sights and several rear sights, all having leaf spring locking members adapted to releasably engage the firearm's transverse receiving groove and indentation. The sights may be of different mechanical configuration (e.g., taller to project above the bore centerline, for use when sighting over a suppressor) or may be similar but vary to move the point of impact up, down, left or right for a given point of aim, so a user can select an appropriate sight from a selection of sights provided in a kit with a firearm. The kit may also contain different types of sights, so that, for a given firearm, front sight blades of two or more heights are included along with a front sight blade carrying a metal bead feature, a front sight blade carrying a tritium insert, a front globe sight and a blade sight painted bright white. The kit may also contain rear sights of different heights and configurations including a rear V-notch sight, a rear sight including an aperture, and a rear sight including one or more tritium inserts.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE PREFERRED EMBODIMENT

Referring now to FIGS. 1 through 8 of the accompanying drawings, the interchangeable sight system 10 of the present invention preferably includes a pistol slide or firearm 12 (e.g., a pistol slide or firearm receiver) having a transverse receiving notch 30. As above, "transverse" means in a left-right direction at a right angle to the pistol bore's central axis and lying in a horizontal plane when the pistol is held in a standard upright grip with the bore central axis in a horizontal plane.

Figure 1:
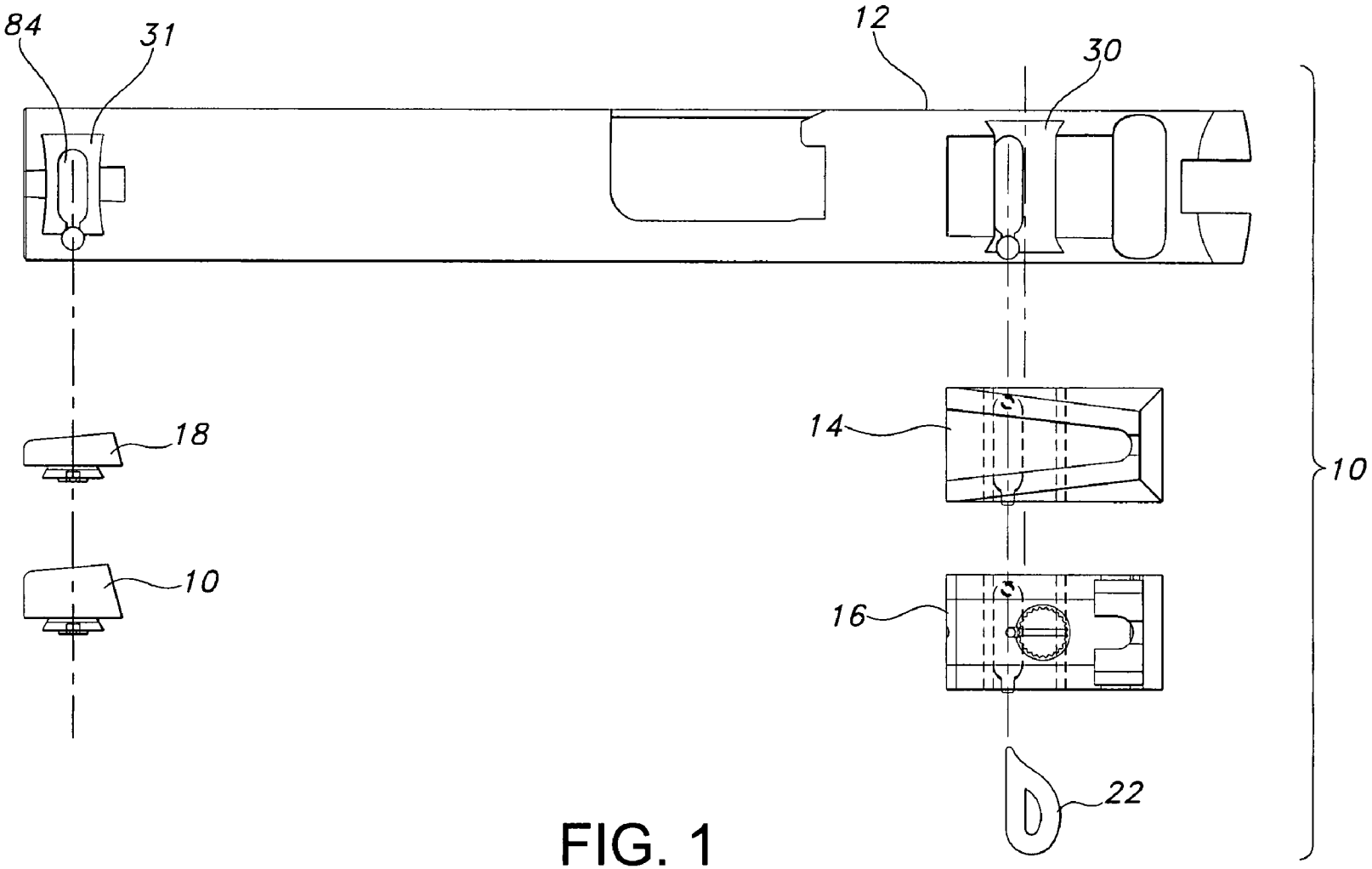
FIG. 1 is an exploded view of an interchangeable sight system, in accordance with the present invention.
Figure 2D:
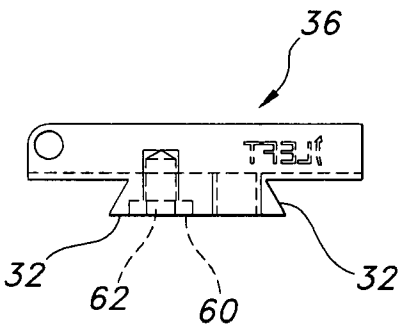
FIGS. 2*a*-2*e* illustrate an embodiment of the standardized sight base of the interchangeable sight system, in accordance with the present invention.
Figure 2E:
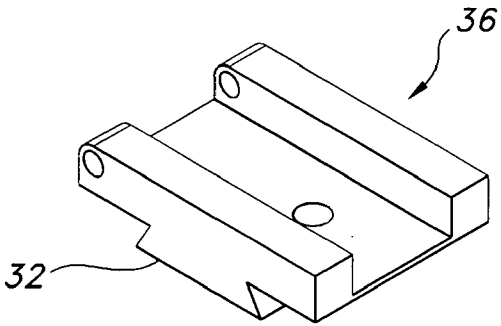
Figure 2C:
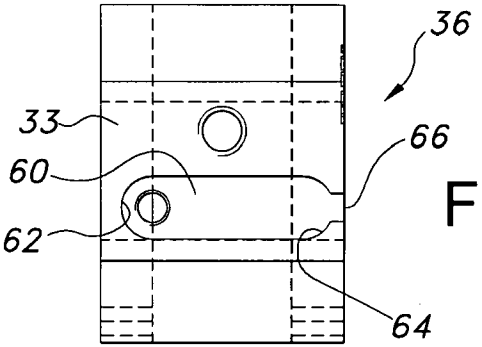
Figure 2B:
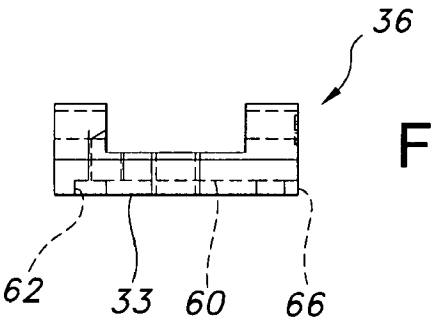
Figure 2A:
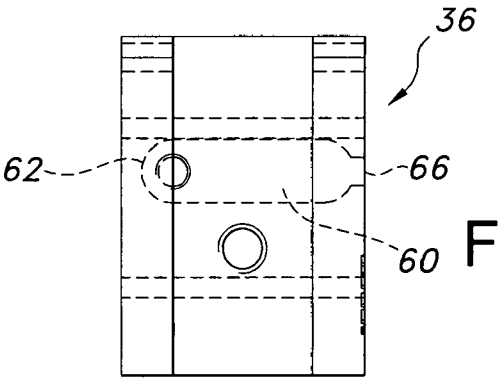

As best seen in FIG. 1, sight system 10 can be embodied as a kit including a plurality of rear sights (e.g., fixed rear sight 14 and adjustable rear sight 16) and a plurality of front sights (e.g., a short front blade 8 and a taller front blade 20), as well as a sight unlocking/removal tool 22.

Figure 4A:
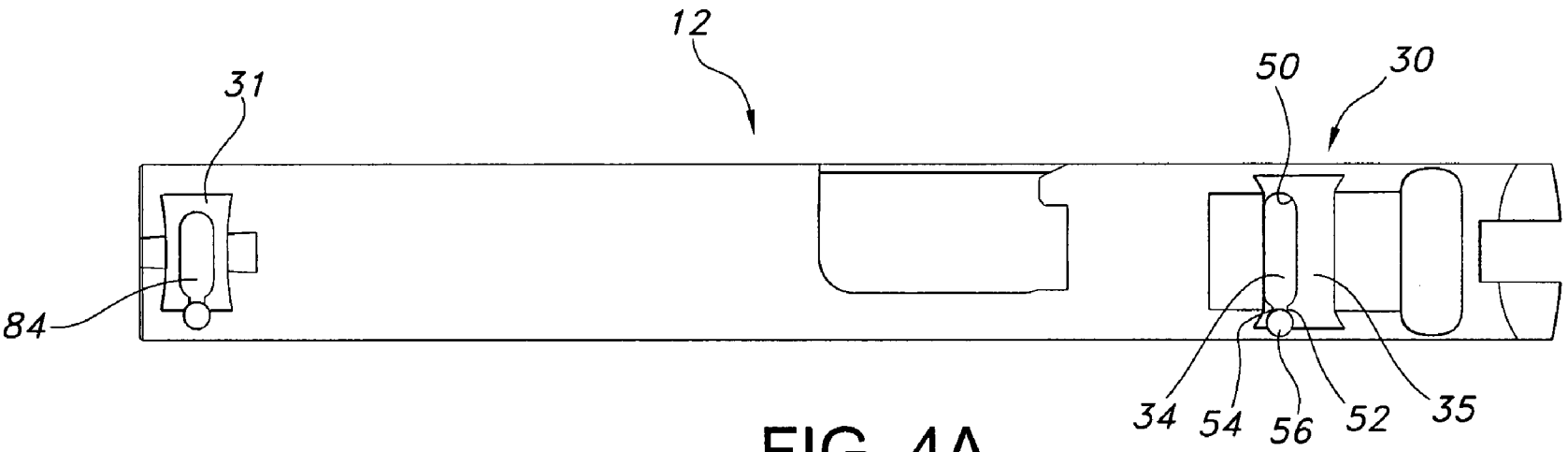
FIG. 4*a* is a top view, in elevation, of a pistol slide illustrating forward sight post receiving notch and rear sight transverse receiving notch with ovoid indentations adapted to interchangeably, removably accept the sights of FIGS. 1-3*e*, 5 and 8, in accordance with the present invention.
Figure 4B:
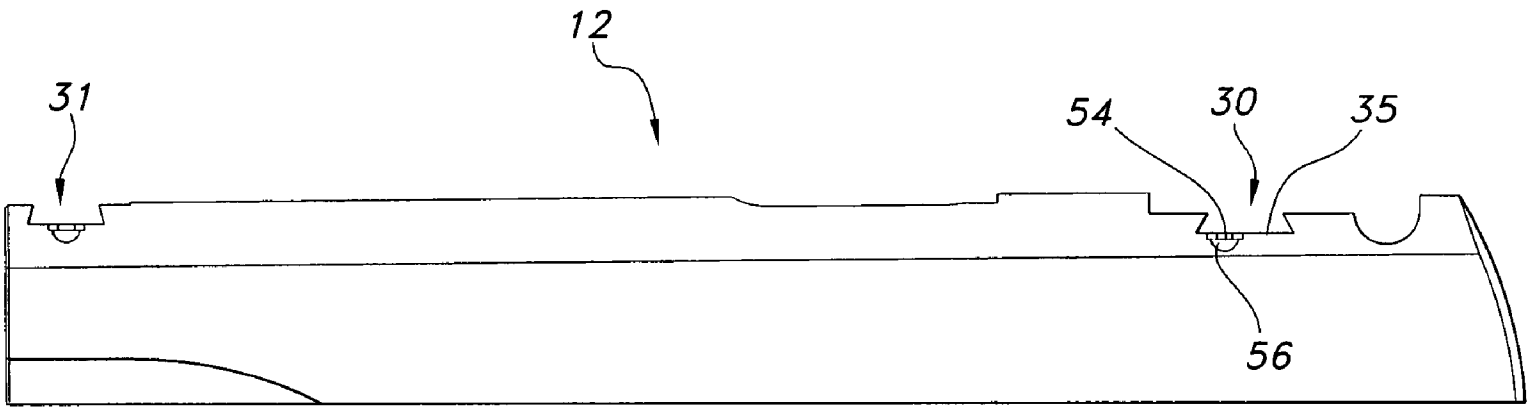
FIG. 4*b* is a left side view, in elevation, of the pistol slide of FIGS. 1 and 4*a*, illustrating the forward sight post receiving notch and the rear sight transverse receiving notch, in accordance with the present invention.

Generally, the standardized dimensions for receiving notch 30 (as best seen in FIGS. 1, 4*a* and 4*b*) define a configuration adapted to accept a Novak-style dovetail-like sight projection 32 (best seen in FIGS. 2*d*, and 3*c*) and so, in the exemplary embodiment, notch 30 is 12.5 millimeters (mm) in fore-aft length along a substantially planar bottom surface 35 and tapers inwardly at seventy degrees from horizontal on front and back wall surfaces; the bottom planar surface 35 of the dovetail shaped receiving notch 30 is preferably three millimeters in vertical height from the bottom surface 35 to the notch's upward facing gap or opening.

The receiving notch's substantially planar bottom surface 35 preferably includes a substantially ovoid transversely elongated detent or indentation 34 configured to slidably receive and releasably engage a locking leaf spring member 40 carried on any of the interchangeable sight's dovetail projections.

Indentation 34 preferably has flat oval bottom surface bounded by a first substantially vertical closed movement limiting end wall 50 opposite a second substantially vertical end wall 52. The indentation's second end wall defines an open segment 54 that provides access to the interior of ovoid indentation 34 from the side of the pistol slide or firearm receiver (e.g., 12).

While the illustrative embodiment shows receiving notch 30 as being transverse, it could be aligned along any axis, so long as the locked-in position of the sight (e.g., 14) is repeatably and releasably fixed in relation to the bore for reliable aiming.

The base 36 of the interchangeable rear sights (e.g., either 14 or 16) is dimensioned to slidably engage the transverse receiving notch 30 and carries, in the exemplary embodiment, dovetail projection 32 that is 12.5 millimeters (mm) in fore-aft length on a planar bottom surface 33 and tapers inwardly at seventy degrees from horizontal on front and back wall surfaces; the bottom planar surface 33 of dovetail projection 32 is preferably three millimeters in vertical height from the upper surface of the base or body of the sight (e.g., 36), within customary gunsmithing tolerances.

Figure 3D:
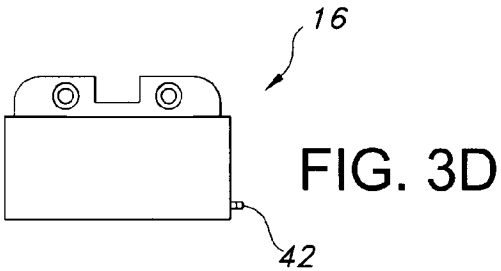
FIGS. 3*a*-3*e* illustrate an embodiment of an adjustable rear pistol sight with the standardized sight base of the interchangeable sight system, in accordance with the present invention.
Figure 3E:
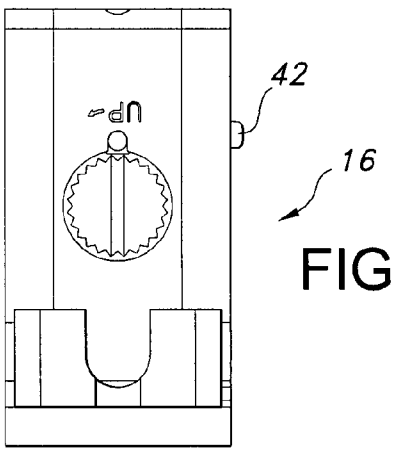
Figure 3C:
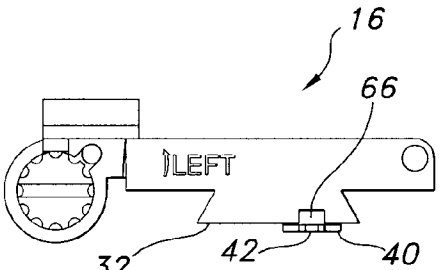
Figure 3B:
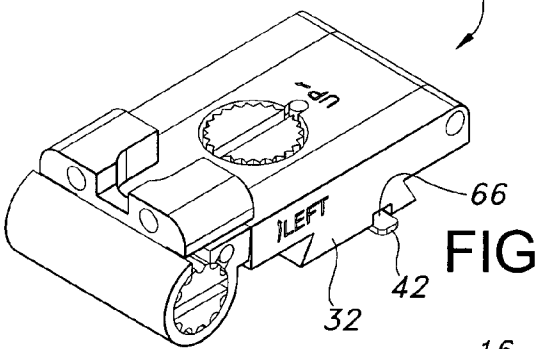
Figure 3A:
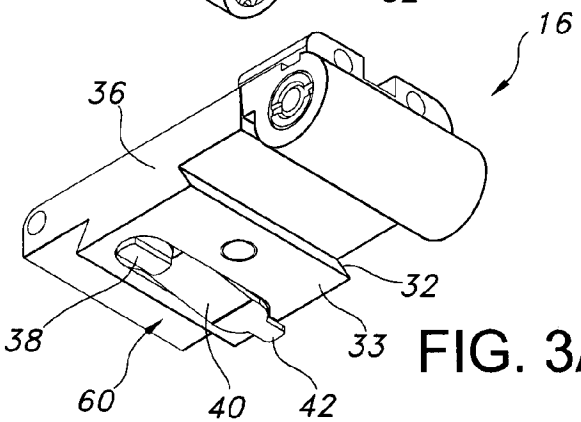
Figure 5:
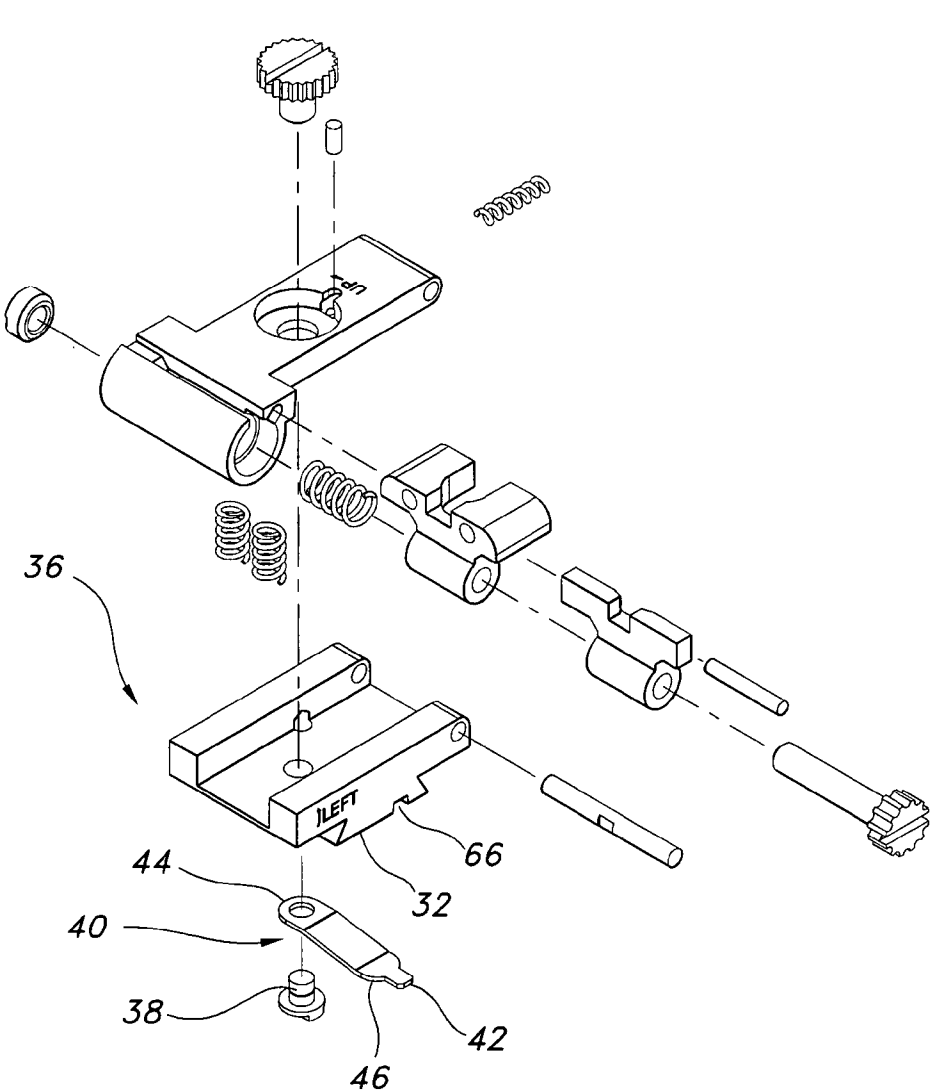
FIG. 5 is an exploded perspective view of an interchangeable, adjustable rear pistol sight showing the leaf spring locking member, in accordance with the present invention.
Figure 7:
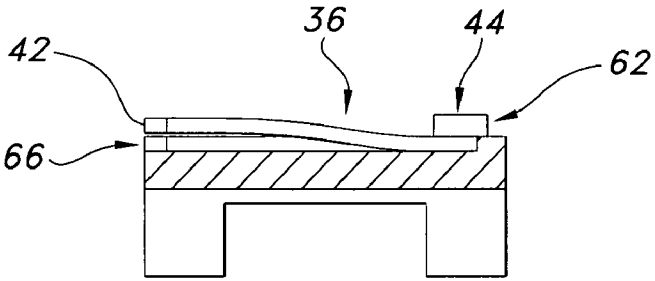
FIG. 7 illustrates the pinning configuration used to retain the locking leaf spring member in the interchangeable sight base, in accordance with the present invention.

As best seen in FIG. 3*a*, the dovetail projection's bottom surface preferably carries a substantially ovoid transversely elongated tempered steel leaf spring biased locking member 40 having a first substantially vertical proximal cylindrical end surface 44 dimensioned to engage and abut the indentation's movement limiting closed end wall 50. Locking member 40 also has a second substantially vertical distal cylindrical end surface 46, opposite the first end surface 44, and second locking member end surface 46 is dimensioned to releasably engage and abut the indentation's second end wall 52. The leaf spring biased locking member 40 is preferably pinned or fastened into the dovetail's bottom surface using a pin or threaded fastener 38, as best seen in FIGS. 3*a* and 5.

Preferably, dovetail projection's bottom surface 33 includes a substantially ovoid transversely elongated indentation 60 having a first substantially vertical closed end wall 62 opposite a second substantially vertical end wall 64. The dovetail indentation's second end wall defines an open segment 66 that provides access to the interior of sight indentation 60 from the side of the dovetail projection 32 and the dovetail's indentation 60 has a sidewall vertical extent (or depth) that substantially equals the thickness of leaf spring biased locking member 40 when pressed flat (e.g., 0.0200 inch thick) so that leaf spring locking member 40 can be forced up against the dovetail bottom surface and completely into dovetail indentation 60, so as to completely disengage the leaf spring biased locking member 40 from the firearm receiver's transverse notch indentation sidewall 52, thereby allowing the sight base (e.g., for sight 14 or 16) to slide along and out of notch 30.

In use, the sight base dovetail projection 32 carrying leaf spring member 40 is inserted into the side opening of the firearm's receiving notch 30 with the pinned end 44 of leaf spring locking member 40 sliding transversely over the receiver indentation's second end wall open segment 54 (at the side of the pistol slide or firearm receiver). The user slides the sight base 36 toward the bore's center axis to its fullest transverse extent, whereupon the leaf spring locking member's vertical pinned end surface 44 rigidly engages and abuts the indentation's first closed movement limiting end wall 50. At this moment, the leaf spring locking member's free distal end 46 is biased to spring or deflect downwardly and the locking member's vertical distal end surface 46 releasably engages and abuts the indentation's second end wall 52, thus releasably locking sight base 36 to the firearm 12 (e.g., the receiver or pistol slide).

The free, distal end 46 of the leaf spring locking member 40 preferably carries a transversely projecting tab or extension 42 that projects laterally out through the receiver indentation's side wall opening 54, so that a user can force a pointed implement or ramp-shaped tool end (such as the removal tool 22 illustrated in FIG. 1) or a screwdriver blade tip against a camming surface 56 on the receiver to force the free, distal end 42 of leaf spring locking member 40 up and away from the indentation's second end wall 52, thus releasing sight base 36 from fixed engagement with the receiving notch. Once leaf spring locking member 40 has been disengaged or unlocked, the user may slide the sight base 36 transversely in the receiver's notch 30 toward and over the receiver indentation's second end wall open segment 54 at the side of the pistol slide or firearm receiver.

Preferably, the firearm side wall includes a spherical indentation (best seen in FIGS. 1, 4*a* and 4*b*) to provide a camming surface 56 proximate the indentation's second end wall open segment 54. A spherical indentation near the indentation's open wall segment 54 permits the leaf spring locking member's transversely projecting tab 42 to project toward the side of the receiver and permits a user to use a variety of implements (e.g., a pointed bullet end, knife or awl) when forcing the free, distal end 46 of leaf spring locking member 40 up to unlock the sight base.

Leaf spring locking member 40 is preferably retained in the dovetail projection by sliding the spring member into a semicircular groove 70 in the dovetail indentation's first sidewall 62. A through-hole 72 in the spring locking member 40 preferably receives a flanged leaf spring member retaining pin 38 that is held captive by a perpendicular keeper pin peened in place after the leaf spring locking member distal end 44 and flanged retaining pin 38 are positioned in dovetail indentation 60 proximate the dovetail indentation's first sidewall 62.

Figure 8:
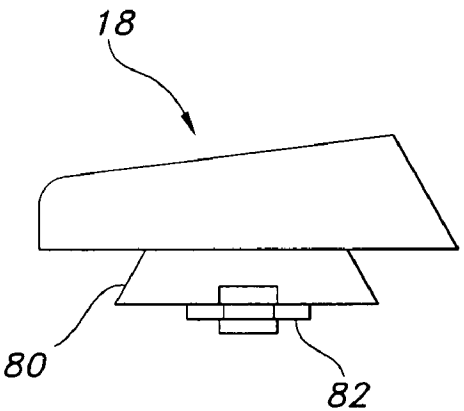
FIG. 8 is a side view, in elevation, of an interchangeable front sight blade, in accordance with the present invention.
Figure 6B:
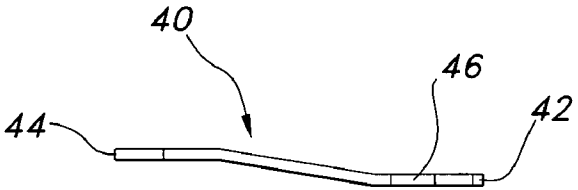
FIGS. 6*a* and 6*b* illustrate the locking leaf spring member used to releasably fasten the interchangeable sights, in accordance with the present invention.
Figure 6A:
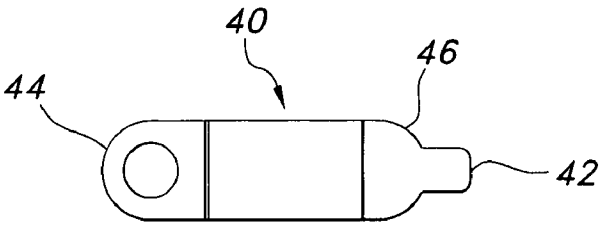

As best seen in FIGS. 1 and 8, interchangeable front sights (e.g., 18 and 20) have standardized bases carrying a dovetail projection 80 that are dimensioned to be releasably locked into a slightly smaller standard front receiving notch 31. Each interchangeable front sight dovetail projection 80 carries a leaf spring biased front locking member 82 to engage side walls of a receiving notch indentation 84 in the bottom surface of front receiving notch 31, and so the interchangeable front sights (e.g., 18 and 20) function in the same manner as the rear sights (e.g., 14 and 16 with bases conforming to interchangeable base 36) but are scaled to smaller dimensions.

As noted above, interchangeable sight system 10 of the present invention may optionally be part of a kit having a plurality of different front sights and a plurality of different rear sights, all having leaf spring locking members adapted to releasably engage the firearm's transverse receiving notch 30 groove and lock into the notch indentation 34. The sights may be of different mechanical configuration (e.g., taller to project above the bore centerline, for use when sighting over a suppressor) or may be similar but vary to move the point of impact up, down, left or right for a given point of aim, so a user can select an appropriate sight from a selection of sights provided in a kit with a firearm. The kit may also contain different types of sights, so that, for a given firearm, front sight blades of two or more heights are included along with a front sight blade carrying a metal bead feature, a front sight blade carrying a tritium insert, a front globe sight and a blade sight painted bright white. The kit may also contain rear sights of different heights and configurations including a rear V-notch sight, a rear sight including an aperture, and a rear sight including one or more tritium inserts.

Having described preferred embodiments of a new and improved interchangeable sight system and method, it is believed that other modifications, variations and changes will be suggested to those skilled in the art in view of the teachings set forth herein. It is therefore to be understood that all such variations, modifications and changes are believed to fall within the scope of the present invention as set forth in the claims.

What is claimed is:

1. A releasably attachable, interchangeable optical alignment system for use with a firearm, comprising:

a firearm having an exterior surface including a receiving notch, said receiving notch having a surface including an indentation bounded by first movement limiting end wall opposing a second end wall having an opening providing communication with the firearm's exterior surface;

a removable sight carrying a spring biased locking member, said sight being adapted for insertion in said notch;

wherein said sight is configured to be slidably positioned to abut said locking member against said receiving notch indentation's movement limiting end wall, and, when abutted, said spring biased locking member releasably locks said sight into a predetermined position upon said firearm; and said spring biased locking member being releasable by moving said spring biased locking member using an implement directed through said indentation second end wall's opening.

2. The releasably attachable, interchangeable optical alignment system of claim 1, wherein said receiving notch has a substantially planar bottom surface with a selected fore-aft length and tapers inwardly at a selected sidewall angle on front and back wall surfaces;

wherein said sight body's leaf spring locking member is carried from a dovetail shaped projection that has a selected vertical height and is adapted to be slidably received in said receiving notch; and wherein the transverse notch's bottom surface preferably includes a substantially ovoid transversely elongated indentation having a first substantially vertical closed movement limiting end wall opposite a second substantially vertical end wall, where the indentation's second end wall defines an open segment that provides access to the interior of the indentation from the side of the firearm.

3. The releasably attachable, interchangeable optical alignment system of claim 2, wherein said transverse notch bottom surface has a fore-aft length of 12.5 millimeters (mm) and tapers inwardly at approximately seventy degrees from horizontal on front and back wall surfaces.

4. The releasably attachable, interchangeable optical alignment system of claim 2, wherein said dovetail shaped projection is approximately three millimeters in vertical height.

5. The releasably attachable, interchangeable optical alignment system of claim 2, wherein said dovetail projection's bottom surface carries a substantially ovoid transversely elongated tempered steel leaf spring biased locking member having a first substantially vertical proximal end surface dimensioned to engage and abut the indentation's first movement limiting closed end wall, said first proximal end surface opposing a second substantially vertical distal end surface dimensioned to releasably engage and abut the indentation's second end wall.

6. The releasably attachable, interchangeable optical alignment system of claim 5, wherein said leaf spring biased locking member is pinned or fastened to the dovetail's bottom surface.

7. The releasably attachable, interchangeable optical alignment system of claim 5, wherein said dovetail projection's bottom surface includes a substantially ovoid transversely elongated indentation having a first substantially vertical closed end wall opposite a second substantially vertical end wall;

wherein the dovetail's indentation second end wall defines an open segment that provides access to the interior of the indentation from the side of the dovetail projection and the dovetail's indentation has a sidewall vertical extent that substantially equals the thickness of said leaf spring biased locking member, so that the leaf spring locking member can be forced against the dovetail bottom surface and completely into the dovetail indentation, so as to completely disengage the leaf spring biased locking member from the firearm's transverse notch.

8. The releasably attachable, interchangeable optical alignment system of claim 7, wherein said dovetail indentation has a sidewall vertical extent or thickness that substantially equals 0.0200 inch.

9. The releasably attachable, interchangeable optical alignment system of claim 7, wherein said dovetail indentation's movement limiting sidewall includes a pocket or groove dimensioned to receive and stabilize the fixed end of said leaf spring biased locking member.

10. A method for interchangeably installing and removing an optical alignment structure onto a structure firearm, comprising the method steps of:

(a) providing a firearm with a receiving notch and an indentation in the receiving notch having a first movement limiting end wall opposing a second end wall, said indentation being defined in a surface in the receiving notch, and wherein the receiver indentation's second end wall has an open segment at the side of the firearm;

(b) providing a removable sight carrying a leaf spring locking member having a pinned end and a free distal end adapted to releasably engage one of the firearm's indentation's side walls; and (c) inserting said sight into the side opening of the firearm's receiving notch with the pinned end of the leaf spring locking member sliding transversely over the receiver indentation's second end wall open segment at the side of the firearm.

11. The method of claim 10, further comprising the method step of:

(d) sliding the sight into the receiving notch to its fullest extent, and locking the leaf spring locking member's pinned end to engage and abut the indentation's first movement limiting end wall.

12. The method of claim 11, further comprising the method step of:

(e) locking said sight into releasable engagement with said firearm by operation of said leaf spring locking member's free distal end which springs down, such that the locking member's distal end releasably engages and abuts the indentation's second end wall, thus releasably locking the sight to the firearm.

13. The method of claim 12, further comprising the method step of:

(e) unlocking said sight from releasable engagement with said firearm by operation of said leaf spring locking member's free distal end by forcing said distal end up, such that the locking member's distal end disengages with the indentation's second end wall, thus releasing the sight base to slidably move in the firearm's receiving notch, for removal.

14. The method of claim 13, further comprising the method step of:

(f) providing a second removable sight carrying a leaf spring locking member adapted having a pinned end and a free distal end to releasably engage one of the firearm's indentation's side walls; and (g) inserting said second sight into the side opening of the firearm's receiving notch with a pinned end of the leaf spring locking member sliding transversely over the receiver indentation's second end wall open segment at a side of the firearm.

15. The method of claim 14, further comprising the method step of:

(h) sliding the second sight into the receiving notch to its fullest extent, and locking the leaf spring locking member's pinned end to engage and abut the indentation's first movement limiting end wall.

16. The method of claim 15, further comprising the method step of:

(i) locking said second sight into releasable engagement with said firearm by operation of said leaf spring locking member's free distal end which springs down, such that the locking member's distal end releasably engages and abuts the indentation's second end wall, thus releasably locking the second sight to the firearm.

17. A kit including a firearm component with a sight mounting feature such as a receiving notch, and an interchangeable set of sights adapted for releasable mounting on the firearm, comprising:

a firearm having an exterior surface including a receiving notch, said receiving notch having a surface including an indentation bounded by first movement limiting end wall opposing a second end wall having an opening providing communication with the firearm's exterior surface;

a first removable sight carrying a spring biased locking member, said first sight being adapted for insertion in said notch;

a second removable sight carrying a spring biased locking member, said second sight being adapted for insertion in said notch;

wherein said first and second sights are each configured to be slidably positioned to abut said locking member against said receiving notch indentation's movement limiting end wall, and, when abutted said spring biased locking member releasably locks a selected one of said first and second sights into a predetermined position upon said firearm;

and wherein said spring biased locking members are each releasable by moving said spring biased locking members using an implement directed through said receiving notch indentation second end wall's opening.

18. The interchangeable sight kit of claim 17, wherein said receiving notch has a substantially planar bottom surface with a selected fore-aft length and tapers inwardly at a selected sidewall angle on front and back wall surfaces;

wherein said first and second sight's leaf spring locking member is carried from a dovetail shaped projection that has a selected vertical height and is adapted to be slidably received in said receiving notch; and wherein the transverse notch bottom surface preferably includes a substantially ovoid transversely elongated indentation having a first substantially vertical closed movement limiting end wall opposite a second substantially vertical end wall, where the indentation's second end wall defines an open segment that provides access to the interior of the indentation from the side of the firearm.

19. The interchangeable sight kit of claim 18, wherein said first sight is a front sight blade having a first height and said second sight is a front sight blade having a second height that is greater than said first height.

20. The interchangeable sight kit of claim 19, wherein said first sight is an adjustable rear sight and said second sight is a fixed rear sight.

* * * * *